US009194345B2

(12) United States Patent
Imai

(10) Patent No.: US 9,194,345 B2
(45) Date of Patent: Nov. 24, 2015

(54) FUEL INJECTION DEVICE

(71) Applicant: DENSO CORPORATION, Kariya, Aichi-ken (JP)

(72) Inventor: Keita Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 134 days.

(21) Appl. No.: 14/071,228

(22) Filed: Nov. 4, 2013

(65) Prior Publication Data

US 2014/0124602 A1 May 8, 2014

(30) Foreign Application Priority Data

Nov. 5, 2012 (JP) ..... 2012-243627

(51) Int. Cl.
*F02M 51/06* (2006.01)
*F02D 41/20* (2006.01)

(52) U.S. Cl.
CPC ..... *F02M 51/061* (2013.01); *F02D 41/20* (2013.01); *F02M 51/0671* (2013.01); *F02D 2041/2006* (2013.01); *F02D 2041/2041* (2013.01); *F02D 2041/2058* (2013.01); *F02D 2200/0602* (2013.01); *F02M 2200/08* (2013.01)

(58) Field of Classification Search
CPC ..... F02M 39/00; F02M 51/00; F02M 51/06; F02M 51/061; F02M 51/0614; F02M 51/0625; F02M 51/0642; F02M 51/0653; F02M 51/0664; F02M 51/0671; F02M 61/14; F02M 2200/08; F02D 41/20; F02D 2041/2006; F02D 2041/2041; F02D 2041/2058; F02D 2200/0602
USPC ..... 239/585.1–585.5
See application file for complete search history.

(56) References Cited

U.S. PATENT DOCUMENTS

| | | | | |
|---|---|---|---|---|
| 4,922,878 | A | 5/1990 | Shinogle et al. | |
| 6,196,195 | B1 | 3/2001 | Trutschel et al. | |
| 6,981,663 | B2 * | 1/2006 | Fukutomi | 239/585.5 |
| 2013/0139791 | A1 | 6/2013 | Kusakabe et al. | |

FOREIGN PATENT DOCUMENTS

| | | |
|---|---|---|
| JP | 10-274076 | 10/1998 |
| JP | 2002-181219 | 6/2002 |
| JP | 2005-307750 | 11/2005 |
| JP | 2005-330934 | 12/2005 |
| JP | 4876174 | 12/2011 |
| JP | 2012-167561 | 9/2012 |

OTHER PUBLICATIONS

Office Action (2 pages) dated Sep. 30, 2014, issued in corresponding Japanese Application No. 2012-243627 and English translation (3 pages).
Imai et al., U.S. Appl. No. 14/071,200, filed Nov. 4, 2013.
Imai, U.S. Appl. No. 14/070,670, filed Nov. 4, 2013.

* cited by examiner

*Primary Examiner* — Christopher Kim
(74) *Attorney, Agent, or Firm* — Nixon & Vanderhye PC

(57) ABSTRACT

A fuel injection device includes a fuel injector and a control portion. The fuel injector is inserted into an attachment hole which is placed at a predetermined position of a cylinder head. The fuel injector has a housing in which a coil is provided. At least a part of the housing which accumulates the coil is surrounded over the whole circumference by an inner circumference surface of the attachment hole. The control portion has an increasing control portion and a holding control portion. The increasing control portion increases a current flowing through the coil to a first target value. The holding control portion holds the current to the first target value.

7 Claims, 10 Drawing Sheets

VOLTAGE
Uboost
Ubatt
0
TIME (ms)
t10
t11
t12
t13
t14
t20
t30
t40
t41
Tpickup
Tboost
Ti COIL CURRENT
IH1
IL1
Ihold1
IH2
IL2
Ihold2
IH3
IL3
Ihold3
ΔI SUCTION FORCE
Fa
Fb
ΔF LIFT AMOUNT
ta
tb
tc
td
tah
Lmax
Tact

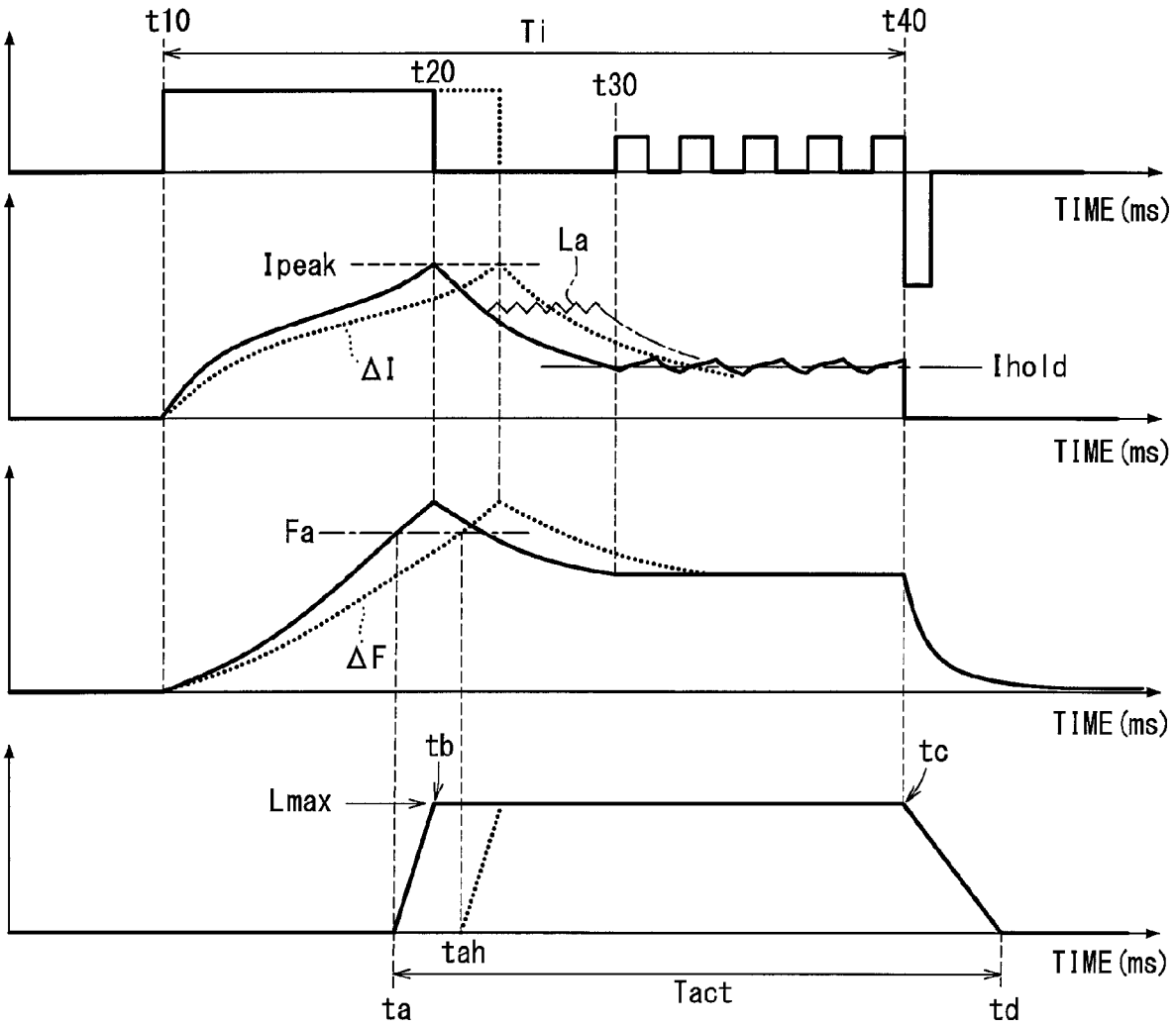
FIG. 13A VOLTAGE
FIG. 13B COIL CURRENT
FIG. 13C SUCTION FORCE
FIG. 13D LIFT AMOUNT

FUEL INJECTION DEVICE

CROSS-REFERENCE TO RELATED APPLICATION

This application is based on Japanese Patent Application No. 2012-243627 filed on Nov. 5, 2012, the disclosure of which is incorporated herein by reference.

TECHNICAL FIELD

The present disclosure relates to a fuel injection device which injects fuel to be combusted in an internal combustion engine.

BACKGROUND

JP-2005-307750A describes a conventional fuel injector which includes a cylinder-shaped housing accommodating a coil, a movable core, a stator core, a valve body and an injection port. The stator core and a part of the housing form a magnetic circuit, which is a passage of a magnetic flux generated by energizing the coil, and generate an electromagnetic force. The movable core is suctioned and moved to the stator core by the electromagnetic force along with the valve body, so that the injection port is opened or closed.

However, in an internal combustion engine in which fuel is directly injected into a chamber, when the fuel injector is inserted into an attachment hole placed at a predetermined position of a cylinder head, an outer circumference surface of the housing is surrounded by an inner circumference surface of the attachment hole over the whole circumference.

When a depth of the fuel injector inserted into the attachment hole is large, a coil portion of the housing which accommodates the coil is inserted into the attachment hole. In this case, a portion of the cylinder head which forms the attachment hole becomes a conductor which is ring-shaped and surrounds the coil portion. Since the magnetic circuit is arranged in the coil portion, the magnetic circuit is surrounded by the conductor. An eddy current is generated in the conductor according to a variation in magnetic flux generated in the magnetic circuit. Thus, the electromagnetic force for suctioning the movable core is decreased by an energy loss due to the eddy current generated in the cylinder head.

SUMMARY

The present disclosure is made in view of the above matters, and it is an object of the present disclosure to provide a fuel injection device in which a decrease in electromagnetic force suctioning a movable core can be restricted.

According to an aspect of the present disclosure, the fuel injection device includes a fuel injector and a control portion. The fuel injector has a coil, a stator core, a movable core, a valve body and a housing. The coil is energized to generate a magnetic flux. The stator core forms a part of a magnetic circuit which is a passage of the magnetic flux and generates an electromagnetic force. The movable core is suctioned by the electromagnetic force. The valve body moves along with the movable core to open or close an injection port. The housing in which the coil is provided forms a part of the magnetic circuit. The fuel injector is inserted into an attachment hole which is placed at a predetermined position of an internal combustion engine. The control portion controls an injection state of the fuel injector by controlling a coil current flowing through the coil.

A portion of the housing which accommodates the coil is referred to as a coil portion, the entire or a part of the coil portion is surrounded over the whole circumference by an inner circumference surface of the attachment hole. The control portion has an increasing control portion and a holding control portion. The increasing control portion applies a voltage to the coil to increase the coil current flowing through the coil to a first target value. The holding control portion applies the voltage to the coil to hold the coil current increased by the increasing control portion to the first target value.

BRIEF DESCRIPTION OF THE DRAWINGS

The above and other objects, features and advantages of the present disclosure will become more apparent from the following detailed description made with reference to the accompanying drawings. In the drawings:

FIG. 13A is a graph showing a relationship between a voltage applied to a coil and time, FIG. 13B is a graph showing a relationship between a coil current and time, FIG. 13C is a graph showing a relationship between the electromagnetic force and time, and FIG. 13D is a graph showing a relationship between a lift amount and time, according to a non-holding control.

DETAILED DESCRIPTION

Figure 1:
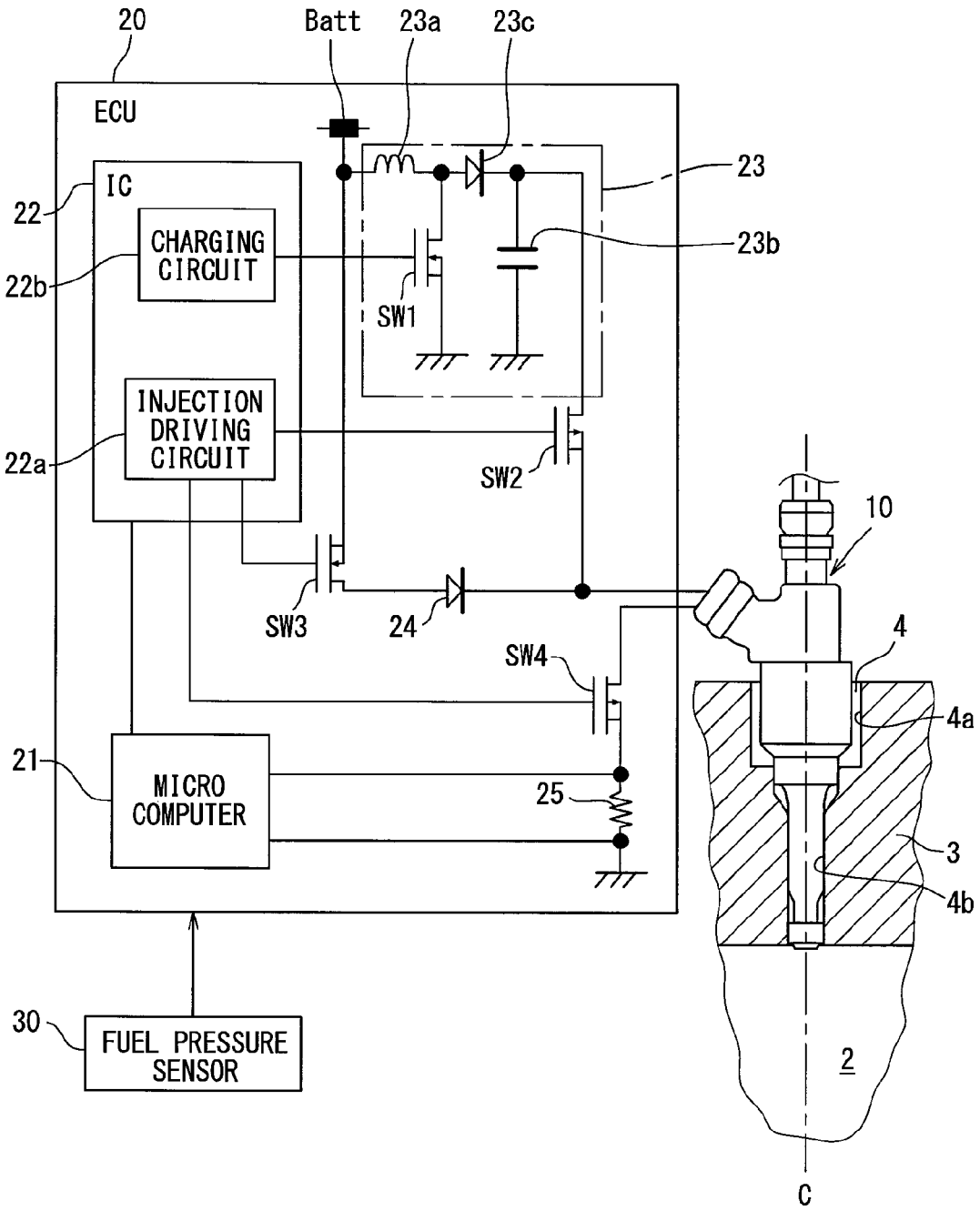
FIG. 1 is a block diagram showing a fuel injection device according to an embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, a fuel injection device according to an embodiment of the present disclosure will be described referring to drawings.

As shown in FIG. 1, a fuel injector 10 is mounted on an internal combustion engine of an ignition type, and directly injects fuel into a combustion chamber 2 of the internal combustion engine. For example, the internal combustion engine may be a gasoline engine. Specifically, an attachment hole 4 for the fuel injector 10 to be inserted into is axially provided in a cylinder head 3 along a center line C of a cylinder.

Figure 2:
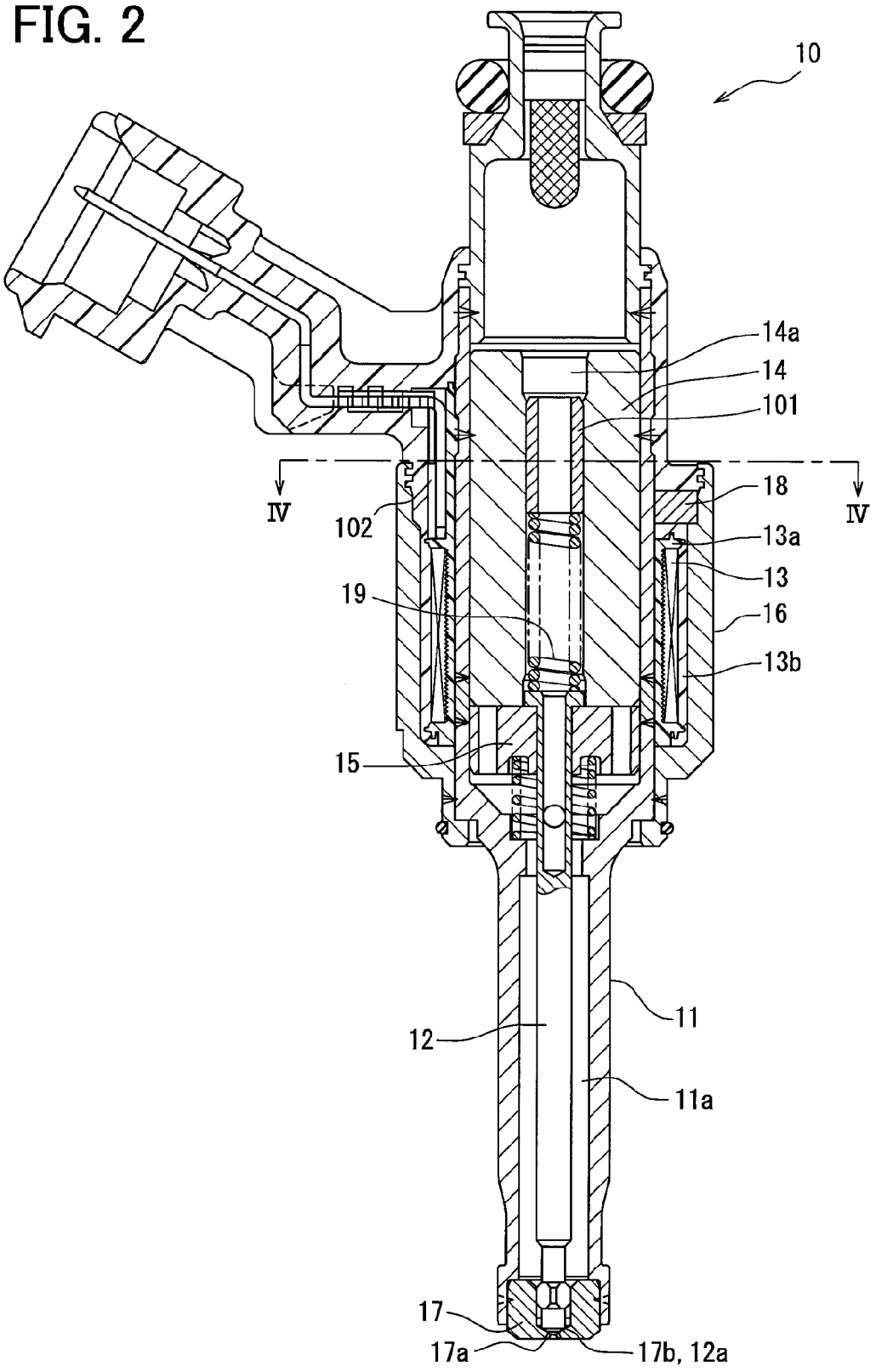
FIG. 2 is a sectional view showing an outline of a fuel injector shown in FIG. 1.

As shown in FIG. 2, the fuel injector 10 includes a body 11, a valve body 12, a first coil 13, a stator core 14, a movable core 15, and a housing 16. The body 11 is made of a magnetic metal material, and has a fuel passage 11*a*. An injection body 17 forming an injection port 17*a* is placed at a position of the body 11 uppermost stream of the fuel passage 11*a*.

The valve body 12 has a seal surface 12*a* for seating or leaving a seat surface 17*b* of the injection body 17. When the valve body 12 is closed so that the seal surface 12*a* is seated on the seat surface 17*b*, a fuel injection from the injection port 17*a* is stopped. When the valve body 12 is opened (lift-up) so that the seal surface 12*a* is detached from the seat surface 17*b*, fuel is injected from the injection port 17*a*.

The first coil 13 is configured by winding a bobbin 13*a* made of resin. The first coil 13 and the bobbin 13*a* are sealed by a resin member 13*b*. Thus, a coil body which is cylinder-shaped is constructed of the first coil 13, the bobbin 13*a* and the resin member 13*b*.

The stator core 14 is cylinder-shaped using a magnetic metal material. The stator core 14 has a fuel passage 14*a*. The stator core 14 is disposed on an inner circumference surface of the body 11, and the bobbin 13*a* is disposed on an outer circumference surface of the body 11. The housing 16 covers an outer circumference surface of the resin member 13*b*. The housing 16 is cylinder-shaped using a magnetic metal material. A cover member 16 made of a magnetic metal material is placed at an opening end portion of the housing 16. Thus, the coil body is surrounded by the body 11, the housing 16 and a cover member 18.

The movable core 15 is disc-shaped using a magnetic metal material, and is disposed on the inner circumference surface of the body 11. The body 11, the valve body 12, the coil body, the stator core 14, the movable core 15 and the housing 16 are arranged so that each axial of them is placed along the same direction. The movable core 15 is placed at a position between the injection port 17*a* and the stator core 14. When the first coil 13 is deenergized, there is a predetermined gap between the movable core 15 and the stator core 14.

The valve body 12 is biased to a close-valve direction by an elastic force of a spring 19. Alternatively, the valve body 12 is biased to the close-valve direction by a pressure of a fuel in the fuel passage 11*a*. The valve body 12 and the movable core 15 are connected with each other. When the first coil 13 is energized, a magnetic suction force is generated so that the movable core 15 is biased to the stator core 14 by the magnetic suction force. Therefore, the valve body 12 is lift-up (open-valve operation). When the first coil 13 is deenergized, the valve body 12 is closed along with the movable core 15 by the elastic force of the spring 19.

Figure 3:
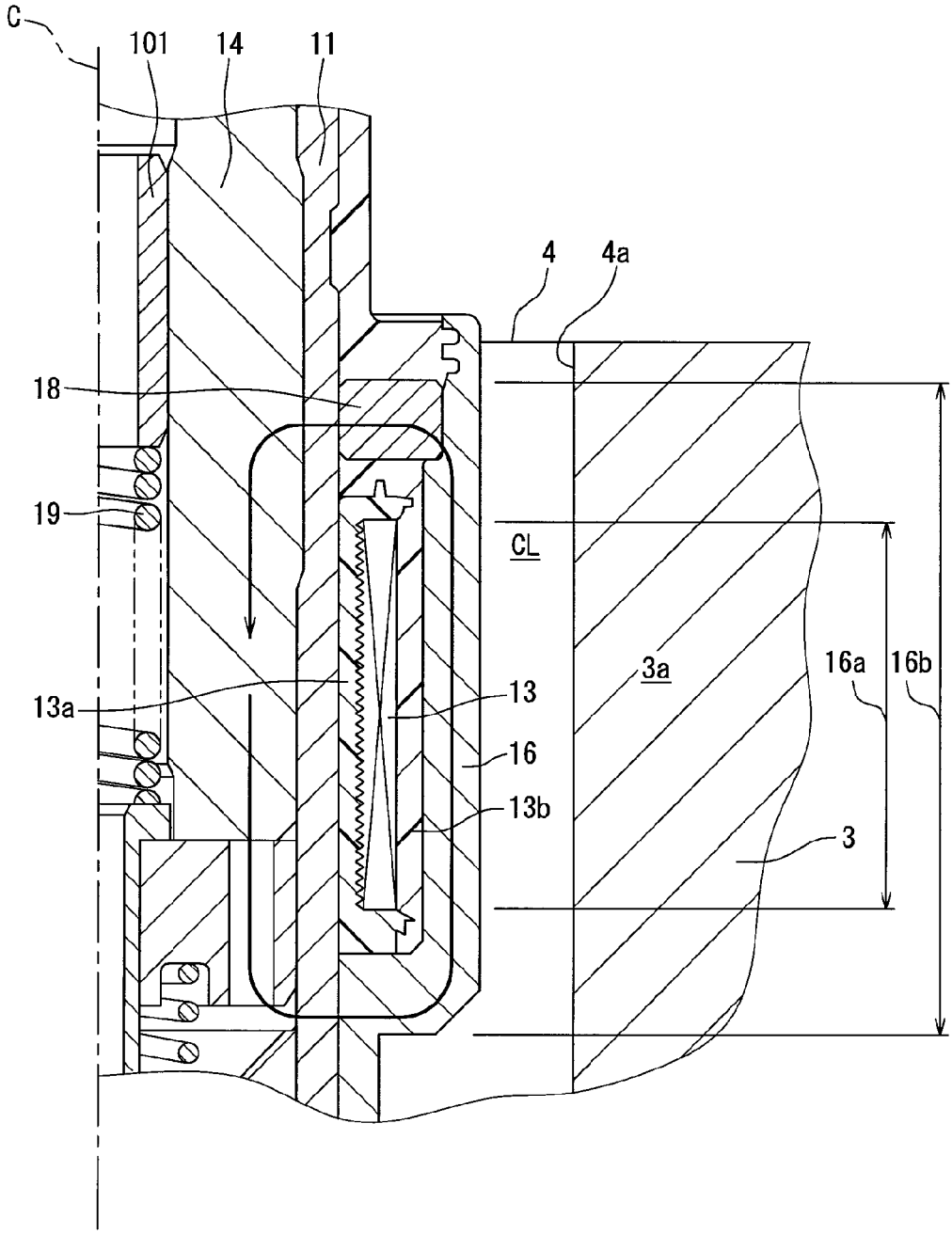
FIG. 3 is an enlarged view showing a part of the fuel injector.

FIG. 3 is an enlarged view showing a part of the fuel injector 10 in a condition that the fuel injector 10 is inserted into the attachment hole 4. Since the body 11, the housing 16, the cover member 18 and the stator core 14 are made of magnetic material, a magnetic circuit which is a passage of a magnetic flux generated by energizing the coil is formed by these parts. That is, as an arrow shown in FIG. 3, the magnetic flux flows through the magnetic circuit.

A portion of the housing 16 which accommodates the first coil 13 is referred to as a coil portion 16*a*. A portion of the housing 16 which forms the magnetic circuit is referred to as a magnetic circuit portion 16*b*. In other words, a position of a first end surface of the cover member 18 farther from the injection port 17*a* than the second end surface of the cover member 18 in an inserting direction is an edge of the magnetic circuit portion 16*b*. As show in FIG. 3, the entire of the coil portion 16*a* and the entire of the magnetic circuit portion 16*b* are surrounded over the whole circumference by a first inner circumference surface 4*a* of the attachment hole 4 in the inserting direction. A portion of the cylinder head 3 which surrounds over the whole circumference of the magnetic circuit corresponds to a conductive ring 3*a*. According to the present embodiment, the conductive ring 3*a* may correspond to a predetermined position of the internal combustion engine.

Figure 4:
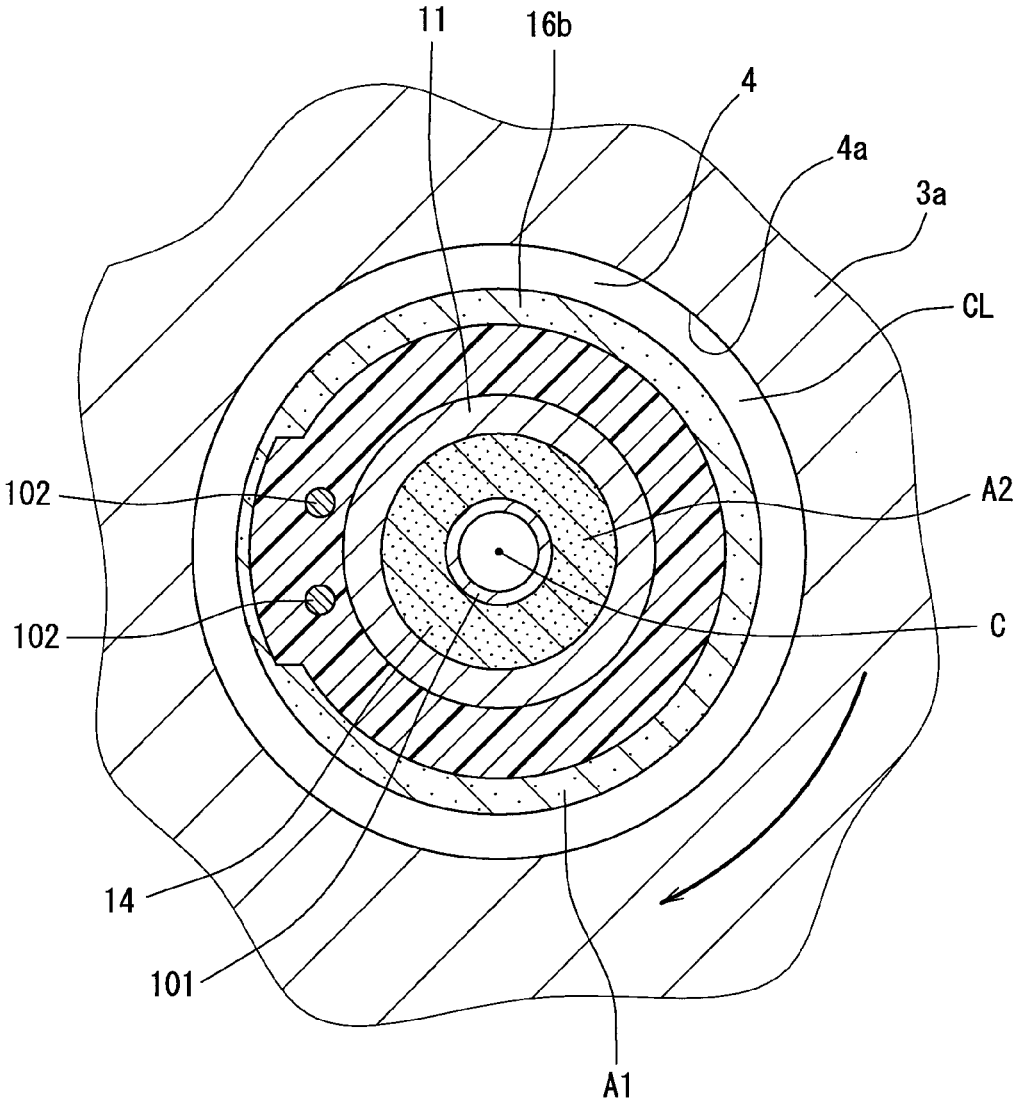
FIG. 4 is a sectional view taken along a line IV-IV in FIG. 2.

As shown in FIG. 1, a second inner circumference surface 4*b* of the attachment hole 4 contacts an outer circumference surface of a portion of the body 11. In this case, the portion of the body 11 is placed between the injection port 17*a* and the housing 16. As shown in FIGS. 3 and 4, a clearance CL is formed between the outer circumference surface of the housing 16 and the first inner circumference surface of the attachment hole 4. That is, the outer circumference surface of the magnetic circuit portion 16*b* and the first inner circumference surface of the attachment hole 4 are opposite to each other with the clearance CL.

In addition, as shown in FIGS. 2 and 4, a regulation pipe 101 is disposed in the stator core 14. The elastic force of the spring 19 is adjustable by regulating an attachment position of the regulation pipe 101. A terminal 102 is configured to supply electrical power to the first coil 13. As an arrow shown in FIG. 4, the magnetic circuit is surrounded by the conductive ring 3*a*. Thus, when the magnetic flux is changed in the magnetic circuit according to a current flowing through the first coil 13, an eddy current is generated in a conductor (cylinder head) due to a variation in magnetic flux. The eddy current flows along a circumference direction of the conductive ring 3*a*.

According to the present disclosure, the eddy current is generated at a predetermined position of the internal combustion engine rather than an eddy current generated in the fuel injector 10.

Figure 5A:
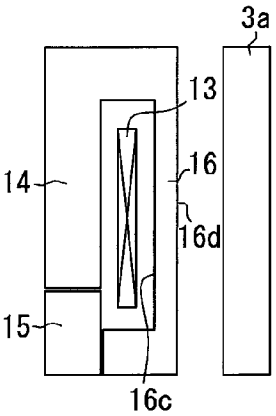
FIGS. 5A to 5J are graphs showing a relationship between a current and a magnetic flux, according to time.
Figure 5B:
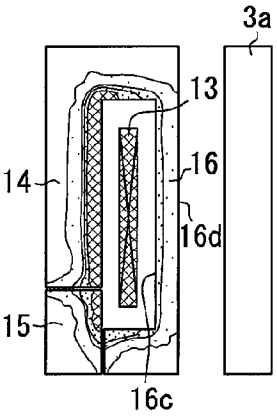
Figure 5C:
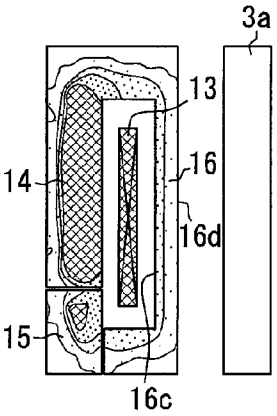
Figure 5D:
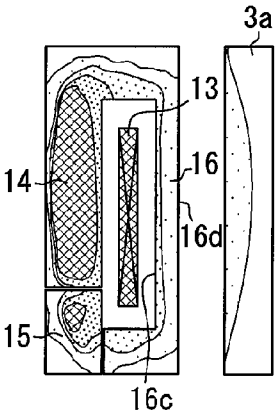
Figure 5E:
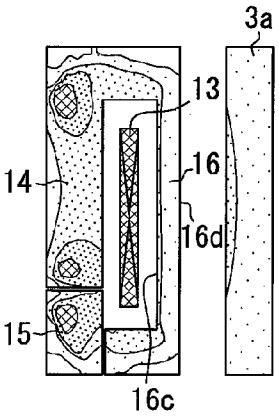
Figure 5F:
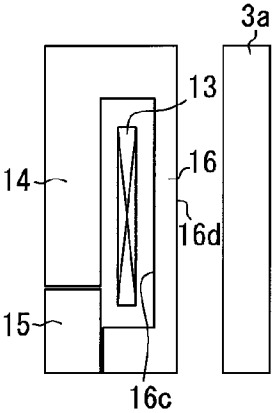

FIGS. 5A to 5J are relative to a analyze result by experiment. FIGS. 5A to 5E are graphs showing a current flowing through the first coil 13, the stator core 14, the movable core 15, the housing 16 and the conductive ring 3*a*. FIGS. 5F to 5J are graphs showing a magnetic flux in the first coil 13, the stator core 14, the movable core 15, the housing 16 and the conductive ring 3*a*. Specifically, FIGS. 5A and 5F are graphs showing states of the current and the magnetic flux before an energization of the first coil 13 is started. When the energization is started, the current varies in an order of FIG. 5B, FIG. 5C, FIG. 5D, FIG. 5E, and the magnetic flux varies in an order of FIG. 5G, FIG. 5H, FIG. 5I, FIG. 5J.

Figure 5G:
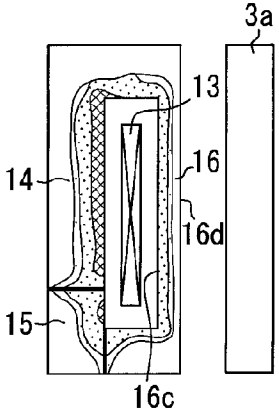
Figure 5H:
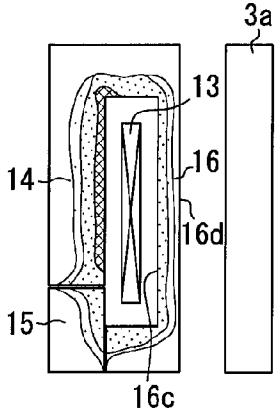
Figure 5I:
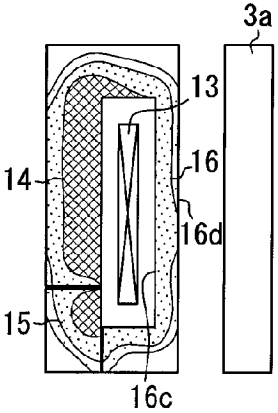
Figure 5J:
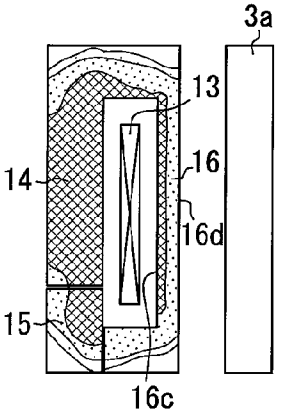

As shown in FIGS. 5B to 5E, the current flowing through the housing 16 is gradually increased. As shown in FIGS. 5G to 5J, the magnetic flux in the housing 16 is also gradually increased. The magnetic flux in the housing 16 close to an inner circumference surface 16*c* is increased more than the magnetic flux in the housing 16 close to an outer circumference surface 16*d*. The inner circumference surface 16*c* is close to the first coil 13. The magnetic flux in the housing 16 close to the inner circumference surface 16*c* is referred to as a first magnetic flux, and the magnetic flux in the housing 16 close to the outer circumference surface 16*d* is referred to as a second magnetic flux. The first magnetic flux reaches a predetermined amount before the second magnetic flux reaches the predetermined amount. Specifically, FIG. 5G shows a graph of when the first magnetic flux reaches the predetermined amount, and FIG. 5I shows a graph of when the second magnetic flux reaches the predetermined amount. As shown in FIG. 5D, the eddy current is generated at the conductive ring 3*a* at a time point that the second magnetic flux reaches the predetermined amount. Then, as shown in FIGS. 5E and 5J, when the second magnetic flux is further increased, the eddy current is increased in accordance with an increase in second magnetic flux.

According to the present embodiment, the eddy current is not generated even though the second magnetic flux varies, until the second magnetic flux reaches the predetermined amount. The eddy current is generated and is increased in accordance with an increase in second magnetic flux, after the second magnetic flux reaches the predetermined amount. In other words, the eddy current is not varied when the second magnetic flux varies right after the coil is energized, but is increased in accordance with an increase in second magnetic flux after the second magnetic flux reaches the predetermined amount.

A first area A1 shown in FIG. 4 is a section area of a magnetic flux passage in the coil portion 16*a* or a section area of a magnetic flux passage in the magnetic circuit portion 16*b*. A second area A2 shown in FIG. 4 is a section area of a magnetic flux passage in the stator core 14. According to the present embodiment, the first area A1 and the second area A2 are set so that the first area A1 is less than a product of the second area A2 multiplied by 1.5.

An electronic control unit (ECU) 20 includes a microcomputer 21, an integrated circuit (IC) 22, a boost circuit 23, and switching elements SW2, SW3 and SW4. According to the present disclosure, the ECU 20 corresponds to a control portion.

Figure 6:
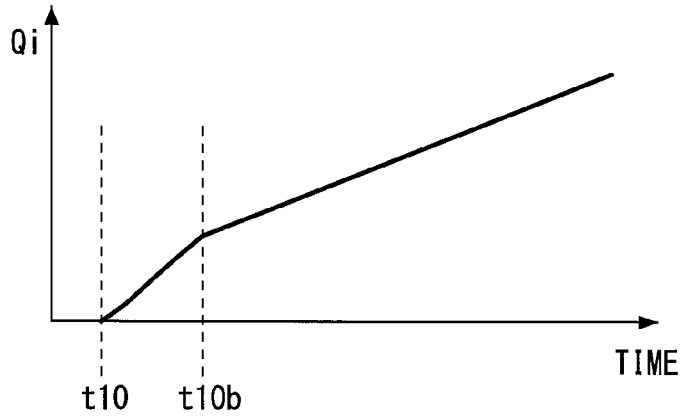
FIG. 6 is a graph showing a relationship between an energization time period and an injection amount.

The microcomputer 21 consists of a center processing unit (CPU), a nonvolatile memory (ROM), and a volatile memory (RAM). The microcomputer 21 computes a target injection amount and a target injection start time point based on a load of the internal combustion engine and an engine speed. An injection amount Qi of the fuel injector 10 is controlled by controlling an energization time period Ti of the first coil 13 according to an injection characteristic shown in FIG. 6. A first time point t10 represents the energization start time point. A second time point t10*b* represents a max opening degree time point that an opening degree of the injection port 17*a* becomes its maximum. In this case, the movable core 15 contacts the stator core 14, and a lift amount of the valve body 12 becomes its maximum.

The IC 22 includes an injection driving circuit 22*a* and a charging circuit 22*b*. The injection driving circuit 22*a* controls the switching elements SW2, SW3, and SW4. The charging circuit 22*b* controls the boost circuit 23. The injection driving circuit 22*a* and the charging circuit 22*b* are operated according to an injection command signal outputted from the microcomputer 21. The injection command signal, which is a signal for controlling an energizing state of the first coil 13, is set by the microcomputer 21 based on the target injection amount, the target injection start time point, and a coil circuit value I. The injection command signal includes an injection signal, a boost signal, and a battery signal.

The boost circuit 23 includes a second coil 23*a*, a condenser 23*b*, a first diode 23*c*, and a first switching element SW1. When the charging circuit 22*b* controls the first switching element SW1 to repeatedly be turned on or turned off, a battery voltage applied from a battery terminal Batt is boosted (boosted) by the second 23*a*, and is accumulated in the condenser 23*b*. In this case, the battery voltage after being boosted and accumulated corresponds to a boost voltage.

When the injection driving circuit 22*a* turns both a second switching element SW2 and a fourth switching element SW4 on, the boost voltage is applied to the first coil 13. When the injection driving circuit 22*a* turns both a third switching element SW3 and the fourth switching element SW4 on, the battery voltage is applied to the first coil 13. When the injection driving circuit 22*a* turns the switching elements SW2, SW3 and SW4 off, no voltage is applied to the first coil 13. When the second switching element SW2 is turned on, a second diode 24 shown in FIG. 1 is for preventing the boost voltage from being applied to the third switching element SW3.

A shunt resistor 25 is provided to detect a current flowing through the fourth switching element SW4, that is, the shunt resistor 25 is provided to detect a current (coil current) flowing through the first coil 13. The microcomputer 21 computes the coil current value I based on a voltage decreasing amount according to the shunt resistor 25.

Figure 7:
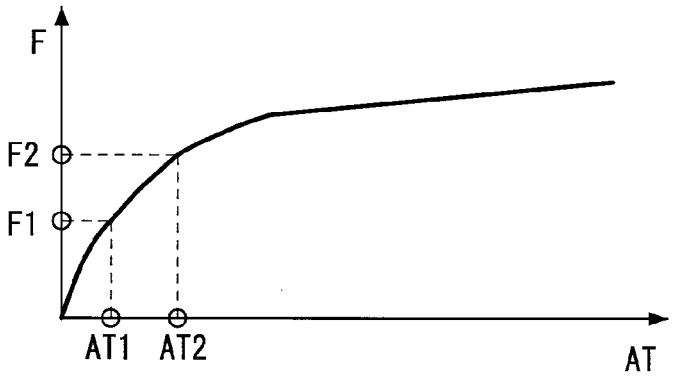
FIG. 7 is a graph showing a relationship between an ampere turn and an electromagnetic force.
Figure 8:
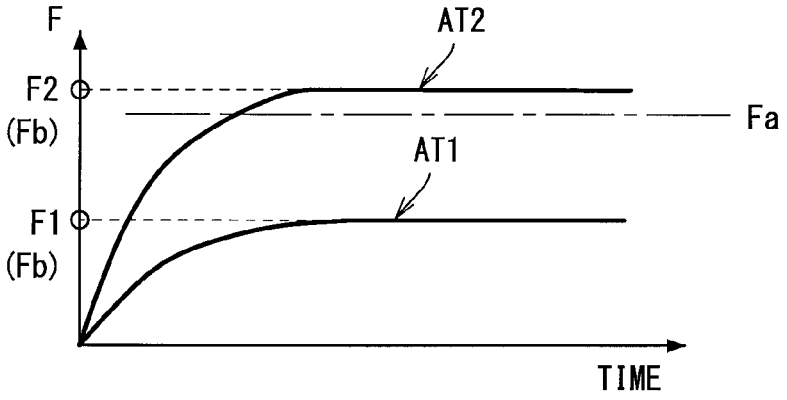
FIG. 8 is a graph showing a relationship between time, the electromagnetic force, and the ampere turn.

Hereafter, the suction force F which suctions the movable core will be described. As shown in FIG. 7, the suction force F is increased in accordance with an increase in magnetomotive force (ampere turn AT) generated in the stator core 14. Specifically, in a condition where a number of turns of the first coil 13 is fixed, a first ampere turn AT1 is less than a second ampere turn AT2, and a first suction force F1 is less than a second suction force F2. As shown in FIG. 8, an increasing time period is necessary for the suction force F to be saturated and become the maximum since the first coil 14 is energized. According to the embodiment, the maximum of the suction force F is referred to as a static suction force Fb.

In addition, the suction force F for opening the valve body 12 is referred to as a required opening force. The required opening force is increased in accordance with an increase in pressure of a fuel supplied to the fuel injector 10. Further, the required opening force may be increased according to various conditions such as an increase in viscosity of fuel. The required opening force of when it is necessary to be a value large enough is referred to as a required force Fa.

Figures 9A, 9B, 9C, 9D:
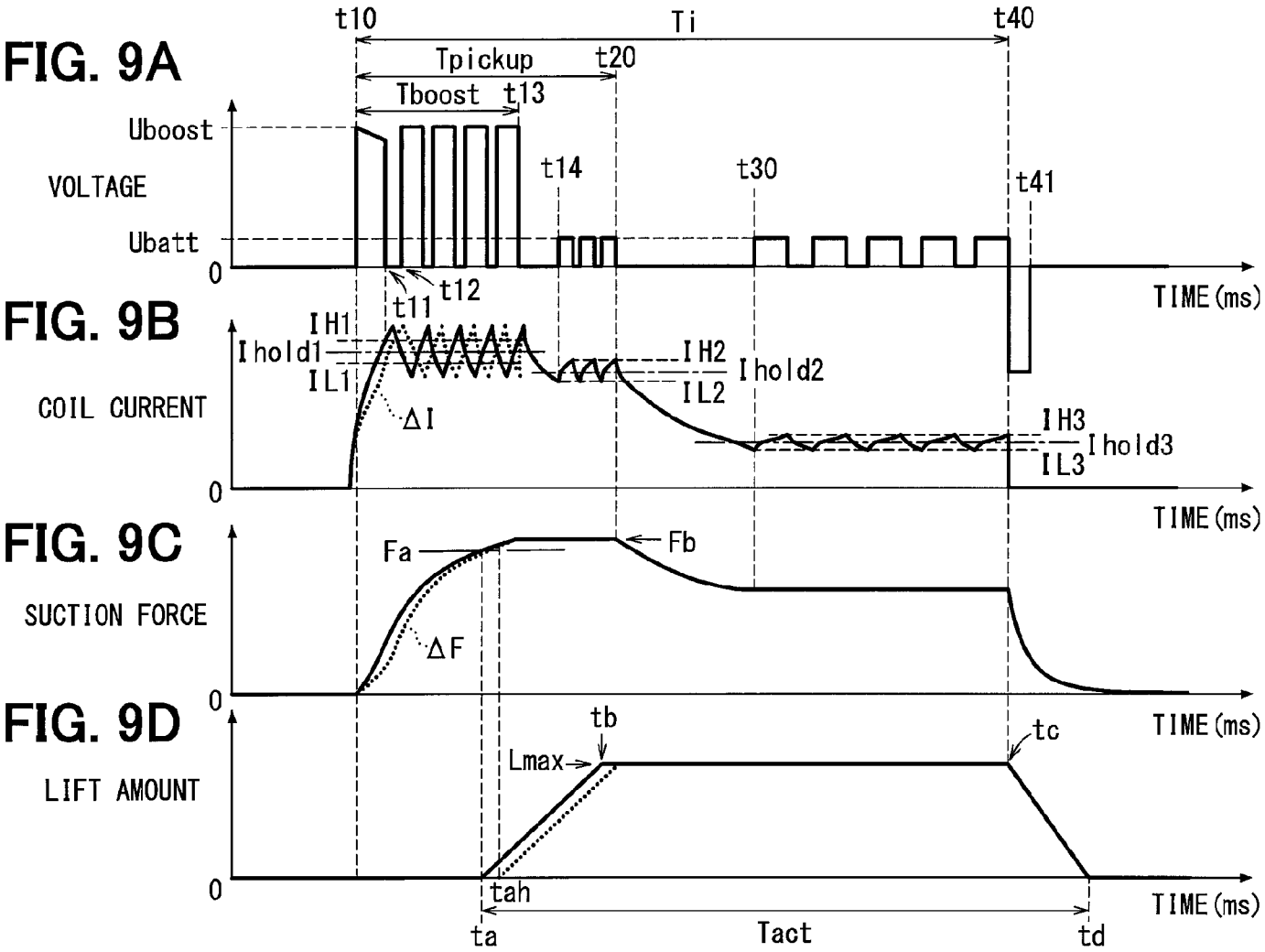
FIG. 9A is a graph showing a relationship between a voltage applied to a coil and time.
FIG. 9B is a graph showing a relationship between a coil current and time.
FIG. 9C is a graph showing a relationship between the electromagnetic force and time.
FIG. 9D is a graph showing a relationship between a lift amount and time.

FIG. 9A is a graph showing a waveform of a voltage applied to the first coil 13 in a case where the fuel injection is executed once. At the first time point t10, the boost voltage Uboost is applied to the first coil 14 so that the first coil 14 is started to be energized. As shown in FIG. 9B, the coil current is increased to a first target value Ihold1 since the first time point t10. Then, at a time point t11 that the coil current is increased to a first upper limit IH1 greater than the first target value Ihold1, the first coil 14 is deenergized. Then, the coil current is started to be decreased.

As shown in FIG. 5, at S11 and S14, the coil current is controlled to be increased to the first target value Ihold1 by the boost voltage Uboost applied to the first coil 14 for the first time. The processing in S11 and S14 may correspond to an increasing control portion which executes an increasing control to control the coil current. A first energization time period of the increasing control is referred to as a first current increasing period which is a time period from the first time point t10 to a time point t11 shown in FIG. 4A. The first target value Ihold1 is set to a value so that the static suction force Fb is greater than or equal to the required force Fa, as shown in FIG. 4C.

As shown in FIGS. 4A and 4B, at a time point t12 that the coil current is decreased to a first lower limit IL1 less than the first target value Ihold1, the first coil 14 is energized again by the boost voltage Uboost. Then, the coil current is started to be increased again. As the above description, the coil current is energized or deenergized by turns from the first time point t10.

As shown in FIG. 5, at S11, S14, S15 and S17, the coil current is controlled by the boost voltage Uboost so that an average value of the coil current is held to the first target value Ihold1. The processing in S11, S14, S15 and S17 may correspond to a holding control portion which executes a first duty control (holding control) in which an on-off energization of the boost voltage Uboost is repeated since the time point t12 to hold the coil current. As shown in FIG. 4A, the holding control is stopped at a time point t13 that a first elapsed time period Tboost reaches a first predetermined time period T1 since the first time point t10. Then, the coil current may be started to be decreased. An on-off energization time period of the holding control is referred to as a current holding period which is a time period from the time point t11 to the time point t13 as shown in FIG. 4A.

As shown in FIGS. 4A and 4B, at a time point t14 that the coil current is decreased to a second lower limit IL2 less than a second target value Ihold2, the first coil 14 is energized by being applied from the battery voltage Ubatt. Then, the coil current is started to be increased. At a time point that the coil current is increased to a second upper limit IH2 greater than the second target value Ihold2, the first coil 14 is deenergized. Then, the coil current is started to be decreased. The coil current is energized or deenergized by turns from the time point t14.

As shown in FIG. 5, at S22, S25, S26 and S28, the coil current is controlled by the battery voltage Ubatt so that the average value of the coil current is held to the second target value Ihold2. The processing in S22, S25, S26 and S28 may correspond to a battery holding control portion which executes a second duty control (battery holding control) in which an on-off energization of the battery voltage is repeated since the time point t14 to hold the coil current. As shown in FIG. 4A, the battery holding control is stopped at a time point t20 that a second elapsed time period Tpickup reaches a second predetermined time period T2 since the first time point t10. Then, the coil current may be started to be decreased. An on-off energization time period of the battery holding control is referred to as a battery holding period which is a time period from the time point t14 to the time point t20 shown in FIG. 4A. The second target value Ihold2 is set to a value where the electromagnetic force which is increased by the increasing control and the holding control can be held.

As shown in FIG. 9B, the second target value Ihold2 is set to a value less than the first target value Ihold1. According to the present disclosure, the second target value Ihold2 may be set to a value equal to the first target value Ihold1.

The first upper limit IH1, the first lower limit IL1, the second upper limit IH2, and the second lower limit IL2 are set so that a variable frequency of the coil current in the current holding period is greater than that in the battery holding period.

As shown in FIG. 4B, an increasing slope of the coil current of when the boost voltage Uboost is applied to the first coil 14 is greater than that of when the battery voltage Ubatt is applied to the first coil 14. As shown in FIG. 9B, the first upper limit IH1, the first lower limit IL1, the second upper limit IH2, and the second lower limit IL2 are set so that a first difference ΔI1 between the first upper limit IH1 and the first lower limit IL1 is equal to a second difference ΔI2 between the second upper limit IH2 and the second lower limit IL2. Thus, the variable frequency in the current holding period is greater than that in the battery holding period. For example, when the second target value Ihold2 is set to a value equal to the first target value Ihold1, the first upper limit IH1 is set to be equal to the second upper limit IH2, and the first lower limit IL1 is set to be equal to the second lower limit IL2, so that the first difference ΔI1 is equal to the second difference ΔI2.

As shown in FIGS. 4A and 4B, at a time point t30 that the coil current is decreased to a third lower limit IL3 less than a third target value Ihold3, the first coil 14 is energized by being applied from the battery voltage Ubatt. Then, the coil current is started to be increased. At a time point that the coil current is increased to a third upper limit IH3 greater than the third target value Ihold3, the first coil 14 is deenergized. Then, the coil current is started to be decreased. The coil current is energized or deenergized by turns from the time point t30.

In a third duty control (lift holding control), the on-off energization of the battery voltage Ubatt is repeated since the time point t30 to hold the coil current. The lift holding control is stopped by the injection command signal at an energization complete time point t40.

The injection signal of the injection command signal is a pulse signal dictating to the energization time period Ti. A pulse-on time point of the injection signal is set to the first time point t10 by an injection delay time earlier than the target energization start time point ta. A pulse-off time point of the injection signal is set to the energization complete time point t40 after the energization time period Ti has elapsed since the first time point t10. The fourth switching element SW4 is controlled by the injection signal.

The boost signal of the injection command signal is a pulse signal dictating to an energization state of the boost voltage Uboost. The boost signal has a pulse-on time point as the same as the pulse-on time point of the injection signal. The boost signal is repeated to be turned on or turned off so that the coil current value I is held to the first target value Ihold1 during the first elapsed time period Tboost reaches the first predetermined time period T1 since the first time point t10. The second switching element SW2 is controlled by the boost signal.

The battery signal of the injection command signal is a pulse signal having a pulse-on time point that the first elapsed time period Tboost reaches the first predetermined time period T1 since the first time point t10. Then, the battery signal is repeated to be turned on or turned off so that the coil circuit value I is feedback controlled and held to the second target value Ihold2, until a time point that the second elapsed time period Tpickup reaches the second predetermined time period T2 since the first time point t10. Then, the battery signal is repeated to be turned on or turned off so that the coil circuit value I is feedback controlled and held to the third target value Ihold3, until a time point that the injection signal is turned off. The third switching element SW3 is controlled by the battery signal.

Figure 10:
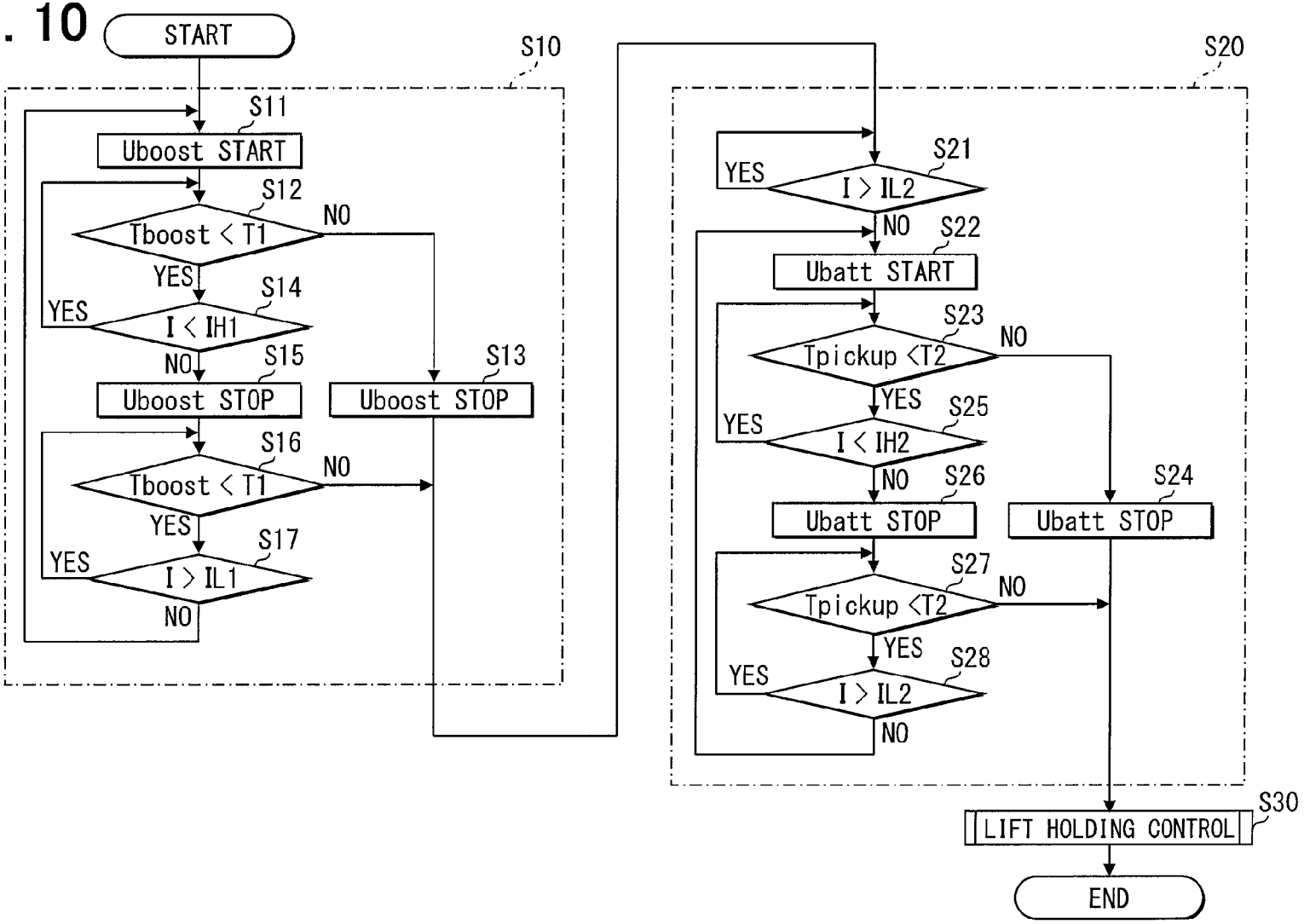
FIG. 10 is a flow chart showing an injection control executed by a microcomputer of the fuel injection device.

The microcomputer 21 outputs the boost signal and the battery signal according to the flowchart shown in FIG. 10. Processings shown in FIG. 10 are executed repeatedly at a predetermined period after the pulse-on time point of the injection signal. As shown in FIG. 10, the increasing control and the holding control are executed according to the processings in S10, the battery holding control is executed according to the processings in S20, and the lift holding control is executed according to the processings in S30.

At S11, the boost signal is turned on such that the boost voltage Uboost is started to be applied to the first coil 14. Then, the boost signal is continuously turned on to apply the boost voltage Uboost to the first coil 14 until the microcomputer 21 determines that the coil current value I reaches the first upper limit IH1 (S14: No). The first upper limit IH1 is set to a value by a predetermined amount greater than the first target value Ihold1. Therefore, the coil current is increased to the first target value Ihold1 in the increasing control, according to the boost voltage applied to the first coil 14 for the first time.

When the first elapsed time period Tboost reaches the first predetermined time period T1 since the first time point t10 (S12: No) due to abnormality before the coil current value I becomes equal to the first upper limit IH1, the microcomputer 21 proceeds to S13. At S13, the microcomputer 21 turns off the boost signal so that the boost voltage Uboost is stopped from being applied to the first coil 14. When the microcomputer 21 determines that the coil current value I is greater than or equal to the first upper limit IH1 (S14: No), the microcomputer 21 proceeds to S15. At S15, the boost voltage Uboost is stopped from being applied to the first coil 14. Then, the increasing control is completed.

When the first elapsed time period Tboost is less than the first predetermined time period T1 (S16: Yes), the boost signal is continuously turned off such that the boost voltage Uboost is stopped from being applied to the first coil 14, until the microcomputer 21 determines that the coil current value I is decreased to the first lower limit IL1 (S17: No). The first lower limit IL1 is set to a value by a predetermined amount less than the first target value Ihold1.

When the microcomputer 21 determines that the coil current value I is less than or equal to the first lower limit IL1 (S17: No), the microcomputer 21 returns to S11. At S11, the boost signal is turned on again such that the boost voltage Uboost is restarted to be applied to the first coil 14. Thus, the boost signal is controlled to be turned on or turned off by the first upper limit IH1 and the first lower limit IL1 as thresholds, until the microcomputer 21 determines that the first elapsed time period Tboost is greater than or equal to the first predetermined time period T1 after the increasing control is completed (S12: No, S16: No). As the above description, in the holding control, an average value of the coil current is held to the first target value Ihold1.

When the microcomputer 21 determines that the first elapsed time period Tboost is greater than or equal to the first predetermined time period T1 (S12: No, S16: No), the boost voltage Uboost is continuously stopped from being applied to the first coil 14, until the microcomputer 21 determines that the coil current value I is decreased to the second lower limit IL2 (S21: No). The second lower limit IL2 is set to a value by a predetermined amount less than the second target value Ihold2. As shown in FIG. 9, the second target value Ihold2 is set to a value less than the first target value Ihold1. According to the present disclosure, the second target value Ihold2 may be set to a value equal to the first target value Ihold1.

When the microcomputer 21 determines that the coil current value I is less than or equal to the second lower limit IL2 (S21: No), the microcomputer 21 proceeds to S22. At S22, the battery signal is turned on such that the battery voltage Ubatt is started to be applied to the first coil 14. Then, the battery signal is continuously turned on to apply the battery voltage Ubatt to the first coil 14 until the microcomputer 21 determines that the coil current value I reaches the second upper limit IH2 (S25: No). The second upper limit IH2 is set to a value by a predetermined amount greater than the second target value Ihold2.

When the microcomputer 21 determines that the coil current value I is greater than or equal to the second upper limit IH2 (S25: No), the microcomputer 21 proceeds to S26. At S26, the battery voltage Ubatt is stopped from being applied to the first coil 14. When the microcomputer 21 determines that the coil current value I is less than or equal to the second lower limit IL2 (S28: No), the microcomputer 21 returns to S22. At S22, the battery signal is turned on again such that the battery voltage Ubatt is restarted to be applied to the first coil 14. Thus, the battery signal is controlled to be turned on or turned off by the second upper limit IH2 and the second lower limit IL2 as thresholds, until the microcomputer 21 determines that the second elapsed time period Tpickup becomes equal to the second predetermined time period T2 after the holding control is completed (S23: No, S27: No). As the above description, in the battery holding control, an average value of the coil current is held to the second target value Ihold2.

When the microcomputer 21 determines that the second elapsed time period Tpickup is greater than or equal to the second predetermined time period T2 (S23: No, S27: No), the microcomputer 21 terminates the battery holding control, turns off the battery signal at S24 or S26, and then proceeds to S30. At S30, the microcomputer 21 turns on or turns off the battery signal so that the coil current value I varies within thresholds from the third lower limit IL3 to the third upper limit IH3. As the above description, in the lift holding control, an average value of the coil current is held to the third target value Ihold3.

In addition, the third upper limit IH3 is set to a value by a predetermined amount greater than the third target value Ihold3, and the third lower limit IL3 is set to a value by a predetermined amount less than the third target value Ihold3. The third target value Ihold3 is set to a value less than the second target value Ihold2.

Hereafter, an operation of the fuel injector 10 according to the above-mentioned various controls will be described in reference with FIGS. 4C and 4D. FIG. 4C is a graph showing a relationship between the suction force F and time, and FIG. 4D is a graph showing a relationship between the lift amount and time.

As shown in FIG. 9C, when the increasing control is started, the suction force F is started to be increased. The suction force F is continuously increased even after the increasing control is completed. During the current holding period where the holding control is executed, the suction force F reaches the required force Fa. As shown in FIG. 9D, the seal surface 12*a* is detached from the seat surface 17*b* such that an open-valve operation (lift-up) is started, at a time point that the suction force F becomes the required force Fa.

When the coil current is held to the first target value Ihold1 by the holding control, the suction force F is increased to the static suction force Fb. That is, the first elapsed time period Tboost is set to the first predetermined time period T1 so that the suction force F can become the static suction force Fb during the current holding period. Since the first target value Ihold1 is set to a value so that the static suction force Fb is greater than or equal to the required force Fa, the suction force F reaches the required force Fa before the suction force F is increased to the static suction force Fb.

The coil current is held to the second target value Ihold2 by the battery holding control after the time point t14 that the battery voltage Ubatt is applied to the first coil 14 instead of the boost voltage Uboost. The second target value Ihold2 is set to a value so that the suction force F increased by the increasing control and the holding control can be held. That is, the suction force F is held to the static suction force Fb during the battery holding period. The second elapsed time period Tpickup is set to the second predetermined time period T2 so that the lift amount can become a maximum value Lmax during the battery holding period.

The suction force F is decreased to a specified value during a time period from the time point t20 to the time point t30, and then is held to the specified value by the lift holding control. A lift position is held to the maximum value Lmax during a time period from the time point t20 to the time point t40. As shown in FIG. 4D, a max start time point tb may be more advanced than the time point t20, and a max end time point tc may be the same as the time point t40.

When the lift holding control is completed, the suction force F is started to be decreased, and the valve body 12 is started to be closed such that the lift amount is decreased. The seal surface 12*a* is attached to the seat surface 17*b* such that the valve body 12 is closed, at a time point td that the lift amount becomes zero. Since a reverse voltage is applied to the first coil 13 from the time point t40 to the time point t41, the coil current is decreased rapidly, and a closing responsivity of the valve body 12 is improved.

Figure 11:
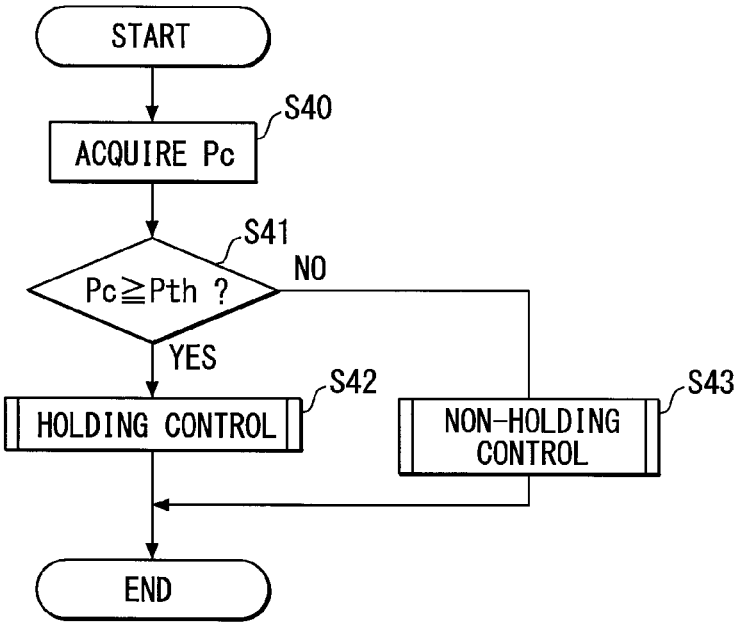
FIG. 11 is a flow chart showing an injection control executed by a microcomputer of the fuel injection device.

A pressure (fuel pressure) Pc of the fuel supplied to the fuel injector 10 is detected by a fuel pressure sensor 30 shown in FIG. 1. The ECU 20 determines whether to execute the holding control according to the fuel pressure Pc. Specifically, as shown in FIG. 11, at S40, the microcomputer 21 acquires the fuel pressure Pc based on a detected value of the fuel pressure sensor 30. At S41, the microcomputer 21 determines whether the fuel pressure Pc is greater than or equal to a predetermined threshold Pth. According to the present embodiment, the processing in S41 corresponds to a switching portion.

When the microcomputer 21 determines that the fuel pressure Pc is greater than or equal to the predetermined threshold Pth (S41: Yes), the microcomputer 21 proceeds to S42. At S42, the microcomputer 21 permits to execute the holding control. Thus, the coil current is according to the flowchart shown in FIG. 10, and thereby an injection state of the fuel injector 10 is controlled. When the microcomputer 21 determines that the fuel pressure Pc is less than the predetermined threshold Pth (S41: No), the microcomputer 21 proceeds to S43. At S43, the microcomputer 21 executes the non-holding control. According to the present embodiment, the processing in S43 corresponds to a non-holding control portion.

In the non-holding control, the boost signal is turned on such that the boost voltage Uboost is started to be applied to the first coil 14. Then, the boost signal is continuously turned on to apply the boost voltage Uboost to the first coil 13 until the microcomputer 21 determines that the coil current value I reaches a forth target value. According to the embodiment, the forth target value is referred to as a predetermined value. Thus, the coil current is increased to the forth target value by the boost voltage Uboost applied to the first coil 13 for the first time. The forth target value is set to a value so that the suction force F can be increased to the required force Fa in the increasing control. Therefore, the forth target value is greater than the first upper limit IH1.

The microcomputer 21 executes the lift holding control as the same as the processing in S30 as shown in FIG. 10 at a time point that the coil current reaches the forth target value. Specifically, the microcomputer 21 turns on or turns off the battery signal so that the coil current value I varies within thresholds from the third lower limit IL3 to the third upper limit IH3. As the above description, in the lift holding control, an average value of the coil current is held to the third target value Ihold3.

According to the present embodiment, since the increasing control portion and the holding control portion are executed, the suction force is increased to the static suction force Fb during a time period from the first time point t10 to the time point t13. Therefore, during a time period from a time point that the energization is started to a time point that the valve body 12 is started to be opened, the coil current is increased to and then is held to the first target value Ihold1.

The electromagnetic force is increased in accordance with an increase in coil current. Even during a time period where the coil current is held to the first target value Ihold1, the electromagnetic force is continuously increased. Therefore, a variation of the coil current just before the valve body 12 is started to be opened can be slowed. In this case, the variation corresponds to a variation of the coil current during the current holding period.

As the above description, a magnetic flux variation rate just before the valve body 12 is started to be opened can be slowed, and a generation of the eddy current in the conductive ring 3*a* can be restricted. Thus, an energy loss due to the eddy current generated in the cylinder head can be reduced, and a lower of the electromagnetic force which suctions the movable core 15 can be restricted.

Hereafter, features of the present embodiment will be described.

(1) According to the present embodiment, the ECU 20 includes the non-holding control portion in which the coil current is lowered after a time point that the coil current is increased to the forth target value to open the valve body 12. Further, the ECU 20 switches between the holding control and the non-holding control according to the fuel pressure Pc.

When the valve body 12 is closed, the fuel pressure Pc applies to the valve body 12 in the close-valve direction. Thus, the required force Fa becomes greater as the fuel pressure Pc becomes greater. When the required force Fa is small, and when the eddy current is not generated, the ECU 20 executes the non-holding control. Thus, it can be avoided that the holding control is executed in a case where the eddy current is not generated.

The increasing rate of the suction force of when the holding control is executed is slower than the increasing rate of the suction force of when the non-holding control is executed. Thus, when the holding control is execute, the injection delay time becomes longer, and a responsivity of an injection start time point becomes lower. When the fuel pressure Pc is small, and when the eddy current is not generated, the ECU 20 executes the non-holding control to improve the responsivity.

(2) According to the present embodiment, as show in FIG. 4, the entire of the coil portion 16*a* is surrounded over the whole circumference by the first inner circumference surface 4*a* of the attachment hole 4 in the inserting direction.

The eddy current of when the entire of the coil portion 16*a* is surrounded is greater than the eddy current of when a part of the coil portion 16*a* is surrounded. Thus, the eddy current is restricted by the increasing control and the holding control.

(3) According to the present embodiment, the entire of the magnetic circuit portion 16*b* is surrounded over the whole circumference by the first inner circumference surface 4*a* of the attachment hole 4 in the inserting direction.

The eddy current of when the entire of the magnetic circuit portion 16*b* is surrounded is greater than the eddy current of when a part of the magnetic circuit portion 16*b* is surrounded. Thus, the eddy current is restricted by the increasing control and the holding control.

(4) According to the present embodiment, the first area A1 and the second area A2 are set so that the first area A1 is less than the product of the second area A2 multiplied by 1.5.

The eddy current generated in the conductive ring 3*a* becomes greater as the first area A1 becomes greater. Based on an experiment for measuring a variation in suction force, the suction force is sharply decreased in a case where the first area A1 is decreased to a value less than the product of the second area A2 multiplied by 1.5.

Figure 12:
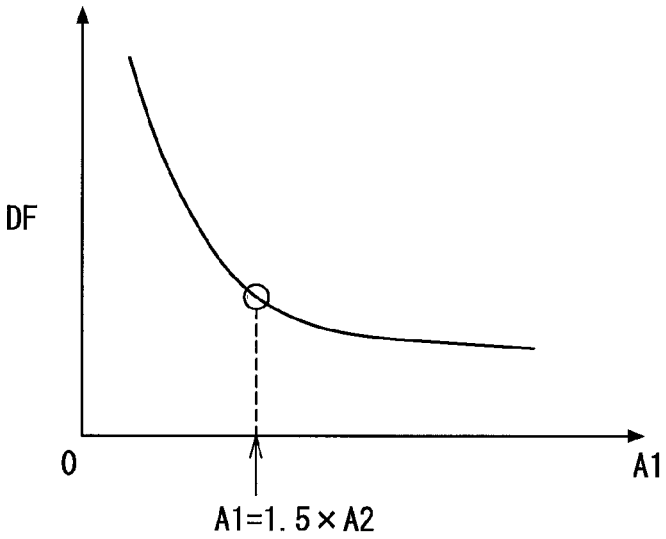
FIG. 12 is a graph showing a relationship between a section area of a magnetic flux passage and a decrease amount of the suction force.

FIG. 12 is a graph showing an experiment result of a relationship between a section area of a magnetic flux passage and a decrease amount DF of the suction force. In the experiment result, a slope of the decrease amount DF becomes sharply at a point that the first area A1 is decreased to the product of the second area A2 multiplied by 1.5. When the first area A1 is set to a value less than the product of the second area A2 multiplied by 1.5, an outer diameter of the housing 16 is reduced so that a size of the fuel injector 10 can be reduced. However, the decrease amount DF may be increased. When the first area A1 is set to a value less than the product of the second area A2 multiplied by 1.5, and when the increasing control and the holding control are executed, both a miniaturization of the fuel injector 10 and a limitation of the decrease amount DF can be improved.

(5) The present embodiment has a first feature that the first target value Ihold1 is set to a value so that the static suction force Fb is greater than or equal to the required force Fa.

As shown in FIG. 9C, the suction force is increased to the static suction force Fb during the time period from the first time point t10 to the time point t13. A ratio of the first current increasing period to a first force increasing period from the first time point t10 to the opening valve start time point to that the suction force reaches the required force Fa can be lowered.

For example, the higher the coil temperature becomes, the greater the coil resistance becomes. In this case, as dotted lines shown in FIGS. 9A and 9B, a second current increasing period from the first time point t10 to the time point t20 that the coil current reaches the target peak value Ipeak becomes longer. Therefore, the third force increasing rate ΔF becomes gentle as shown in FIG. 9C, the opening valve start time point ta becomes slower, and the opening valve time period Tact becomes shorter. Specifically, the opening valve start time point ta of when the coil temperature is normal is more advanced than a high-temperature injection start time point tah. The current increasing rate ΔI is changeable according to the temperature characteristic. Therefore, in the first current increasing period, the third force increasing rate hF is affected by the temperature characteristic. Since the coil current is held to the first target value Ihold1 in the current holding period, the third force increasing rate ΔF is not affected by the temperature characteristic in the current holding period.

Since the ratio of the first current increasing period to the first force increasing period can be lowered, a level for the third force increasing rate ΔF to receive the affect of the temperature characteristic can be lowered. As shown in FIGS. 13A to 13D, in the non-holding control, the coil current is lowered to a holding value Ihold at a time point that the coil current reaches the target peak value Ipeak. Thus, a conventional current increasing period and a conventional force increasing period both correspond to a time period from the first time point t10 to the time point t20. In this case, a ratio of the conventional current increasing period to the conventional force increasing period is 100%. Therefore, a level for the conventional force increasing rate hF to receive the affect of the temperature characteristic is raised. For example, a dotted line shown in FIG. 13C shows the conventional force increasing rate hF when the coil temperature is high.

According to the present embodiment, since a variation in the third force increasing rate ΔF due to the temperature characteristic can be lowered, a variation in the opening valve start time point ta and a variation in the opening valve time period Tact, which are varied in reliance on the temperature characteristic, can be restricted. A deterioration in accuracy of the injection state with respect to the first time point t10 and the energization time period Ti can be restricted, and the robustness of a control to the temperature characteristic can be improved.

(6) In the increasing control and the holding control, a voltage applied to the first coil 14 is controlled so that the valve body 12 is started to be opened in a time period that the coil current is held to the first target value Ihold1. That is, the voltage in the increasing control or a voltage apply time period of the voltage is controlled so that the valve body 12 is not opened in the increasing control. Further, a duty ratio in the holding control or the current holding period is controlled so that the valve body 12 is started to be opened in the holding control.

Thus, the valve body 12 is not opened in the increasing control, and the ratio of the first current increasing period to the first force increasing period can be certainly lowered.

(3) In the increasing control and the holding control, the boost voltage boosted by the boost circuit 23 is applied to the first coil 13. When the holding control is completed, the battery holding control in which the battery voltage is applied to the first coil 13 is executed so as to hold the coil current to the second target value Ihold2. The second target value Ihold2 is set to a value so that the suction force increased by the increasing control and the holding control can be held to the static suction force Fb.

When the current holding period becomes longer than necessary, a time period including the second current increasing period and the current holding period both using the boost voltage becomes longer, and the consumption energy may be increased at each injection. It is necessary that a capacity of the condenser 23*b* becomes greater.

According to the present embodiment, the battery holding control is executed after the holding control is executed. Since it is possible to hold the coil current to the second target value Ihold2 by the battery voltage after a time point that the coil current reaches the second target value Ihold2 by the boost voltage, the battery voltage is applied to the first coil 14 instead of the boost voltage. Therefore, the consumption energy can be reduced, and the condenser 23*b* can have a small capacity.

Other Embodiment

The present invention is not limited to the embodiments described above, but may be performed, for example, in the following manner. Further, the characteristic configuration of each embodiment can be combined.

(1) According to the embodiment, the entire of the magnetic circuit portion 16*b* is surrounded over the whole circumference by the first inner circumference surface 4*a* of the attachment hole 4. However, according to the present disclosure, a part of the magnetic circuit portion 16*b* may be surrounded over the whole circumference by the first inner circumference surface 4*a* of the attachment hole 4. Alternatively, the entire of the coil portion 16*a* may be surrounded over the whole circumference by the first inner circumference surface 4*a* of the attachment hole 4 in the inserting direction. Alternatively, a part of the coil portion 16*a* may be surrounded over the whole circumference by the first inner circumference surface 4*a* of the attachment hole 4 in the inserting direction.

(2) According to the embodiment, the ECU 20 switches between the holding control and the non-holding control according to the fuel pressure Pc. However, according to the present disclosure, the ECU 20 may execute the holding control without considering the fuel pressure Pc.

(3) According to the embodiment, the first elapsed time period Tboost and the first target value Ihold1 are previously fixed. However, the first elapsed time period Tboost and the first target value Ihold1 can be settable according to the fuel pressure Pc. For example, when the fuel pressure Pc becomes greater, it is preferable to set the first target value Ihold1 to a smaller value and to set the first elapsed time period Tboost to a greater value in order to restrict the eddy current.

(4) According to the embodiment, the battery holding control is executed after the holding control is executed so that the suction force is held to the static suction force Fb by the battery holding control. However, according to the present disclosure, the boost voltage is continued to be applied to the first coil 14 by the holding control to hold the suction force to the static suction force Fb without the battery holding control, even after the suction force reaches the static suction force Fb by the holding control.

(5) According to the embodiment, the second target value Ihold2 is set to a value less than the first target value Ihold1. However, the second target value Ihold2 may be set to a value equal to the first target value Ihold1.

(6) According to the embodiment, the first difference between the first upper limit IH1 and the first lower limit IL1 is set to a value equal to the second difference between the second upper limit IH2 and the second lower limit IL2. However, the first difference may be set to a value different from the second difference.

(7) As shown in FIG. 1, the fuel injector 10 is provided in the cylinder head 3. However, according to the present disclosure, the fuel injector 10 may be provided in a cylinder block. Further, according to the embodiment, the fuel injector 10 mounted on the internal combustion engine of the ignition type is used as a controlled subject. However, a fuel injector mounted on an internal combustion engine of a compression self-ignition type such as a diesel engine may be used as the controlled subject. Furthermore, the fuel injector 10 directly injecting fuel into the combustion chamber 2 is used as the controlled subject. However, a fuel injector injecting fuel into an intake pipe may be used as the controlled subject.

(8) According to the embodiment, in the non-holding control, the ECU 20 increases the coil current to the forth target value, decreases the coil current to the third lower limit IL3, and then holds the coil current to the third target value Ihold3 using the battery voltage Ubatt. However, according to the present disclosure, the ECU 20 may hold the coil current to a fifth target value using the boost voltage Uboost after increasing the coil current to the forth target value. For example, a dotted-dashed line La shown in FIG. 13B may represent the fifth target value. The fifth target value may be set to a value between the third low limit IL3 and the forth target value. The ECU 20 may decrease and hold the coil current to the third target value Ihold3 after holding the coil current to the fifth target value for a predetermined time period.

What is claimed is:

1. A fuel injection device comprising:

a fuel injector configured to insert into an attachment hole which is placed at a predetermined position of an internal combustion engine, the fuel injector having:

a coil energized to generate a magnetic flux;

a stator core forming a part of a magnetic circuit which is a passage of the magnetic flux and generating an electromagnetic force;

a movable core suctioned by the electromagnetic force;

a valve body moving along with the movable core to open or close an injection port; and a housing in which the coil is provided, the housing forming a part of the magnetic circuit; and a control portion controlling an injection state of the fuel injector by controlling a coil current flowing through the coil, wherein a portion of the housing which accommodates the coil is referred to as a coil portion, the entire or a part of the coil portion is surrounded over a whole circumference by an inner circumference surface of the attachment hole, the control portion includes an increasing control portion applying a voltage to the coil to increase the coil current to a first target value, and a holding control portion applying a voltage to the coil to hold the coil current increased by the increasing control portion to the first target value, and the increasing control portion and the holding control portion control the voltage applied to the coil so that the valve body starts to be opened in a time period where the coil current is held to the first target value.

2. A fuel injection device according to claim 1, wherein the control portion further includes a non-holding control portion applying a voltage to the coil to decrease the coil current after the coil current is increased to a predetermined value to open the valve body, and a switching portion switching between the holding control portion and the non-holding control portion according to a pressure of a fuel supplied to the fuel injector.

3. A fuel injection device according to claim 1, wherein the entire of the coil portion is surrounded over the whole circumference by the inner circumference surface.

4. A fuel injection device according to claim 1, wherein a portion of the housing which forms the magnetic circuit is referred to as a magnetic circuit portion, and the entire of the magnetic circuit portion is surrounded over the whole circumference by the inner circumference surface.

5. A fuel injection device according to claim 1, wherein a section area of a magnetic flux passage in the coil portion is referred to as a first area A1, a section area of a magnetic flux passage in the stator core is referred to as a second area A2, and the first area A1 and the second area A2 have a relationship that the first area A1 is less than a product of the second area A2 multiplied by 1.5.

6. A fuel injection device according to claim 1, wherein a suction force required for starting to open the valve body is referred to as a required opening force, the suction force saturated by holding the coil current to the first target value is referred to as a static suction force, and the first target value is set to a value so that the static suction force is greater than or equal to the required opening force.

7. A fuel injection device according to claim 1, further comprising:

a boost circuit boosting a battery voltage to a boost voltage; and a battery holding control portion applying the battery voltage to the coil to hold the coil current to a second target value after the holding control portion is executed, wherein the increasing control portion and the holding control portion applies the boost voltage boosted by the boost circuit to the coil, and the second target value is set to a value where a suction force which is increased by the increasing control portion and the holding control portion can be held.

* * * * *